United States Patent [19]

Reese

[11] 4,211,434

[45] Jul. 8, 1980

[54] COMBINATION CONTAINER AND CONTROL FORM FOR SHIPPING, IDENTIFYING AND REORDERING MERCHANDISE

[76] Inventor: Jonathan Reese, 604 NE. 25th Ave., Hallandale, Fla. 33009

[21] Appl. No.: 774,120

[22] Filed: Mar. 3, 1977

Related U.S. Application Data

[60] Continuation of Ser. No. 588,068, Mar. 13, 1975, abandoned, which is a division of Ser. No. 348,066, Apr. 5, 1973, abandoned, which is a continuation-in-part of Ser. No. 207,249, Dec. 13, 1971, abandoned.

[51] Int. Cl.[2] ..... B41L 1/26

[52] U.S. Cl. ..... 282/11.5 A

[58] Field of Search ..... 229/69, 70, 72, 73; 283/1 B; 282/11.5 R, 11.5 A, 25, 22 R, 23 R

[56] References Cited

U.S. PATENT DOCUMENTS

| | | | |
|---|---|---|---|
| 1,177,886 | 4/1916 | Newcomb | 283/1 B |
| 2,954,154 | 9/1960 | Mooney | 229/70 |
| 3,428,237 | 2/1969 | Dowen | 229/69 |
| 3,437,259 | 4/1969 | Steidinger | 282/11.5 A |
| 3,658,239 | 4/1972 | Foutz | 229/72 X |

FOREIGN PATENT DOCUMENTS

| | | | |
|---|---|---|---|
| 687354 | 2/1953 | United Kingdom | 282/22 R |

*Primary Examiner*—Stephen C. Pellegrino
*Attorney, Agent, or Firm*—Robert E. Burns; Emmanuel J. Lobato; Bruce L. Adams

[57] ABSTRACT

An assembly for shipping, stocking and reordering merchandise comprises a container for receiving the merchandise, a label identifying the merchandise in the container, the customer to whom the merchandise is to be shipped and an order number, and a detachable reorder form which identifies the customer and the merchandise and provides a blank for filling in the quantity of merchandise to be reordered. Thus the same merchandise can be reordered from the supplier merely by detaching the reorder form, filling in the desired quantity and returning the reorder form to the supplier. Preferably the assembly further includes one or more detachable identification labels suitable for attachment to individual pieces of merchandise. By way of example the assembly comprises a three-ply continuous manifold divided by spaced transverse tear lines into a succession of rectangular units each having a sealable envelope for shipping merchandise, a pocket for a card controlling the filling of an order for the merchandise, a plurality of severable labels for attachment to individual articles of merchandise by the customer, and duplicate stubs for reordering the merchandise. The labels bear identification of the merchandise and the reorder stubs and the face of the envelope bear identification of the merchandise and of the customer and an order number.

14 Claims, 7 Drawing Figures

COMBINATION CONTAINER AND CONTROL FORM FOR SHIPPING, IDENTIFYING AND REORDERING MERCHANDISE

This is a continuation of application Ser. No. 588,068, filed Mar. 13, 1975, now abandoned, which is a divisional of application Ser. No. 348,066, filed Apr. 5, 1973 (now abandoned) which is a continuation-in-part of application Ser. No. 207,249, filed Dec. 13, 1971 (now abandoned).

The present invention relates to a combination container and control form for shipping, stocking and reordering merchandise. Although not limited to its field of application, the combined shipping container and control form in accordance with the invention is particularly useful in shipping goods from a supplier to a retailer or wholesaler, or in supplying parts or components to a manufacturer.

Heretofore, when a customer has desired to reorder merchandise from a supplier he has generally used his own order form. In making out the order it has been necessary for him to fill in the name and address of the supplier and an identification of the desired goods as well as the quantity of goods desired. Not only does this require an appreciable amount of paper work but affords the possibility of error, for example in the identification of the goods being reordered.

It is an object of the present invention to provide a combined shipping container and control form that facilitates the shipping, identification, inventorying and reordering of the merchandise and thereby reduces the labor and hence the cost involved in these operations. It not only makes possible important economies to the supplier or wholesaler in the processing and shipping of orders and reorders of merchandise, but also promotes good customer relations by assisting the customer in keeping an inventory of the merchandise and in reordering the merchandise when his supply needs to be replenished. Moreover, the form in accordance with the present invention preferably provides one or more detachable tags or labels which are suitable for attachment to individual pieces of the merchandise.

While the combined shipping container and control form in accordance with the present invention is useful in many different fields for many different kinds of merchandise, it is herein described by way of example for use in merchandising and shipping small articles such as jewelry, watches and watch parts, and electronic components from a supplier or wholesaler to retailers or to a manufacturer using component parts.

When used for shipping small articles, the combination containers and control forms in accordance with the present invention are conveniently made in the form of a continuous manifold suitable for processing by high speed computer controlled equipment, thereby making possible important economies in the processing of the customer's orders. Such equipment may include a high speed printer for printing on the container or attached label in identification of the merchandise in the container, the customer to whom merchandise is to be shipped and an order number. Moreover, at the same time the printer prints on a reorder form the identity of the customer and the merchandise while leaving a blank to be filled in as to the quantity of merchandise to be reordered. Hence when he wishes to reorder the merchandise, the customer need only fill in the quantity and return the reorder form to the supplier. This not only reduces the labor and hence the cost involved in the transaction, but also reduces the possibility of error.

The nature and advantages of the invention will be more fully understood from the following description of a preferred embodiment of the invention shown by way of example in the accompanying drawings in which.

Figure 1:
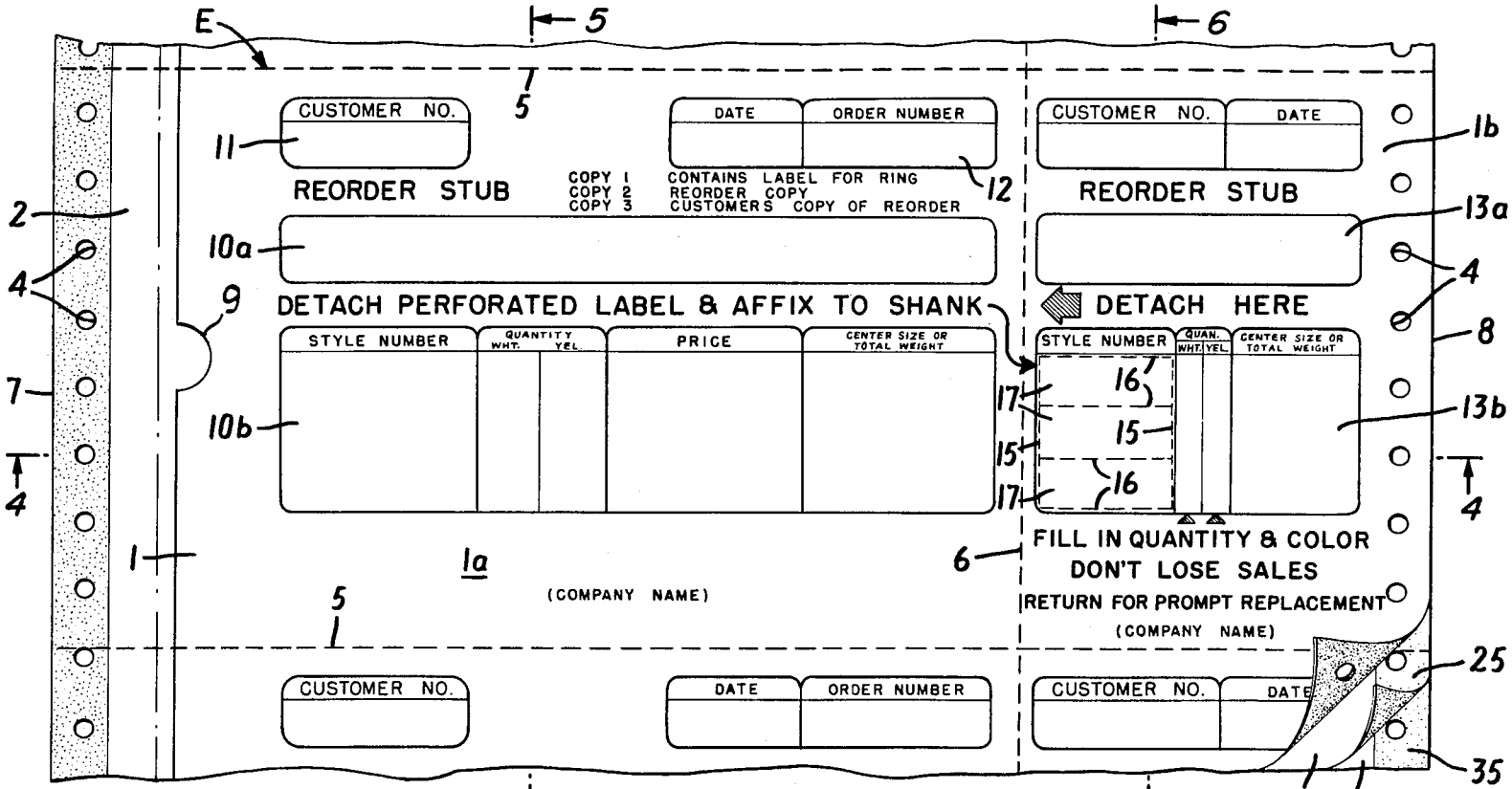
FIG. 1 is a front view of a representative portion of a three-ply manifold in accordance with the present invention suitable for merchandising jewelry, for example, rings.

The manifold shown by way of example in the drawings comprises three superposed plies each formed of a continuous band or strip of paper or other strong, flexible, cheap material. Adjacent each of the side edges of the manifold there is provided a row of spaced holes 4 for feeding the manifold through a printer or other processing equipment. The manifold is continuous but is provided with longitudinally spaced, transversely extending tear lines 5, herein referred to as a line of perforations, along which the manifold is readily parted to provide a succession of like units. Moreover the manifold is provided with a longitudinally extending tear line 6 which is spaced farther from the left-hand edge 7 as seen in FIG. 1, than from the right-hand side edge 8 so as to divide each of the units into a larger rectangular portion and a smaller rectangular portion. The cuts or perforations of the tear lines 5 and 6 extend through all three plies of the manifold so that all of the plies can be parted simultaneously along the tear lines.

The larger left-hand portion 1*a* of the front ply 1 of the manifold to the left of the tear line 6 forms the front of an envelope E which is adapted to receive the merchandise to be shipped. The left-hand edge 7*a* of the front ply 1 is spaced inwardly from the side edge 7 of the manifold and is provided with an arcuate cut-out 9 at the center of each of the units. The front ply of the envelope is provided with a description 10*a* of the merchandise and with further identification 10*b* of the merchandise, for example, by style, number, quantity, price and size. The front of the envelope is further provided with an identification 11 of the customer, for example, a customer number, and with an order number 12. Other information may be provided on the front of the envelope E such as the date, the name of the supplier, and instructions for using reorder stubs and labels as described below.

The smaller portion 1*b* of the front ply 1 at the right-hand side of the tear line 6 as seen in FIG. 1 likewise bears a description 13*a* of the merchandise and further identification 13*b* showing, for example, the style number, quantity and size of the rings or other merchandise to be shipped in the envelope E. Other information such as the order number, date, company name and instructions may also be provided on the portion 1*b*. The portion 1*b* is further provided with spaced longitudinally extending tear lines 15 and spaced transversely extending tear lines 16 defining a plurality of tags or labels 17 which are separable from the rest of the portion 1*b* and from each other along the tear lines. The tear lines 15 and 16 are formed by perforations through the first ply only of the manifold. Each of the tags or labels 17 carries suitable identification of merchandise to be received in the envelope, for example, a style number. The rear faces of the tags or labels 17 are provided with adhesive so that they can be attached to individual pieces of merchandise, for example, by sticking the labels on the merchandise or, in the case of rings, folding the tag of label around the shank of the ring and sticking opposite end portions of the tag or label together. Alternatively the tags or labels 17 may be affixed to the merchandise in other suitable manner, for example, by stapling. While only three labels have been illustrated in FIG. 1, it will be understood that the number and size of labels can be increased or decreased as desired.

Figure 2:
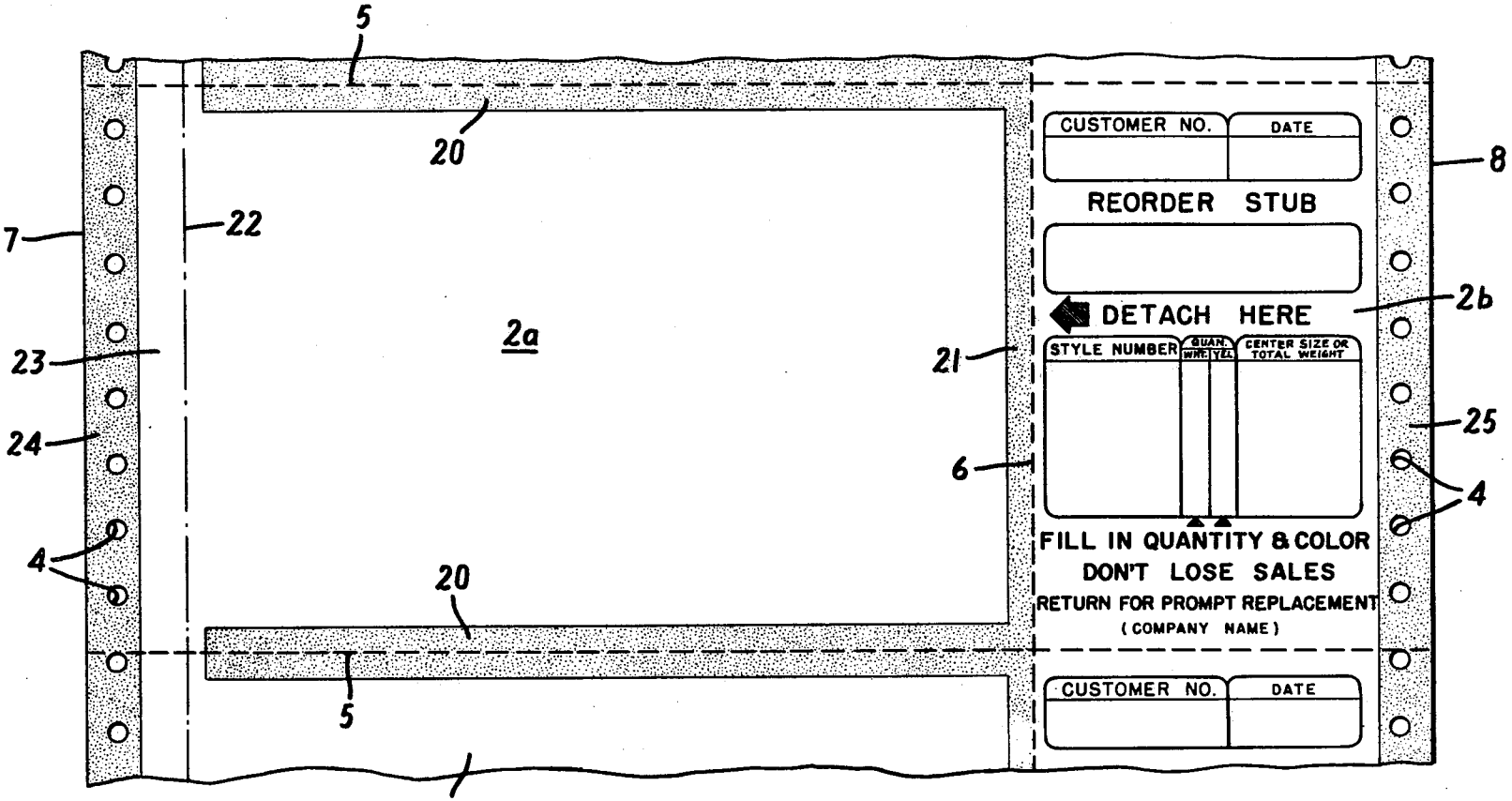
FIG. 2 is a corresponding view showing the second ply.

With reference to FIG. 2, the larger rectangular portion 2*a* of the second ply 2 of each unit forms the back of the envelope E and is adhesively bonded to the front ply 1*a* by transverse glue lines 20 extending along the transverse tear lines 5 and a longitudinally extending glue line 21, extending along the longitudinal tear line 6. The front and the back of the envelope are thus united along three edges while the fourth edge is open. A portion 23 of the second ply 2 extends laterally beyond the edge 7*a* of the first ply 1 so as to form a flap of the envelope adapted to be folded over along a fold line 22. The feed holes 4 at the left-hand side of the manifold are located in this flap portion 23. Adhesive 24 is provided on the flap 23 so as to seal the envelope.

The smaller portion 2*b* of the second ply 2 at the right-hand side of the tear line 6 as seen in FIG. 2 constitutes a reorder stub to be used in reordering the same items of merchandise when it is desired to replenish the stock. The reorder stub contains the same information as on the part 1*b* of the first ply 1 including a description 13*a* of goods, further identification 13*b* of the goods, customer number 14, etc. However it is not provided with perforations corresponding to the perforation lines 15 and 16 of the first ply. At the right-hand margin of the manifold the portion 2*b* of the second ply is separably attached to the portion 1*b* of the first ply by a line of adhesive 25. The width and strength of the adhesive line 25 may be varied and may be narrower than shown so as to facilitate separation of the reorder stub 2*d* of the second ply from the portion 1*b* of the first ply.

Figure 4:
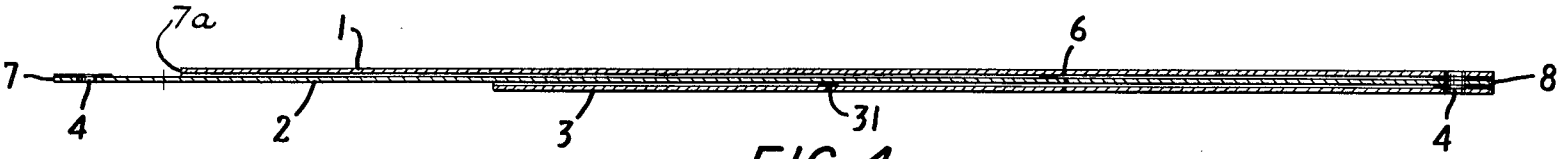
FIG. 4 is a longitudinal section taken approximately on the line 4—4 in FIG. 1.
Figure 3:
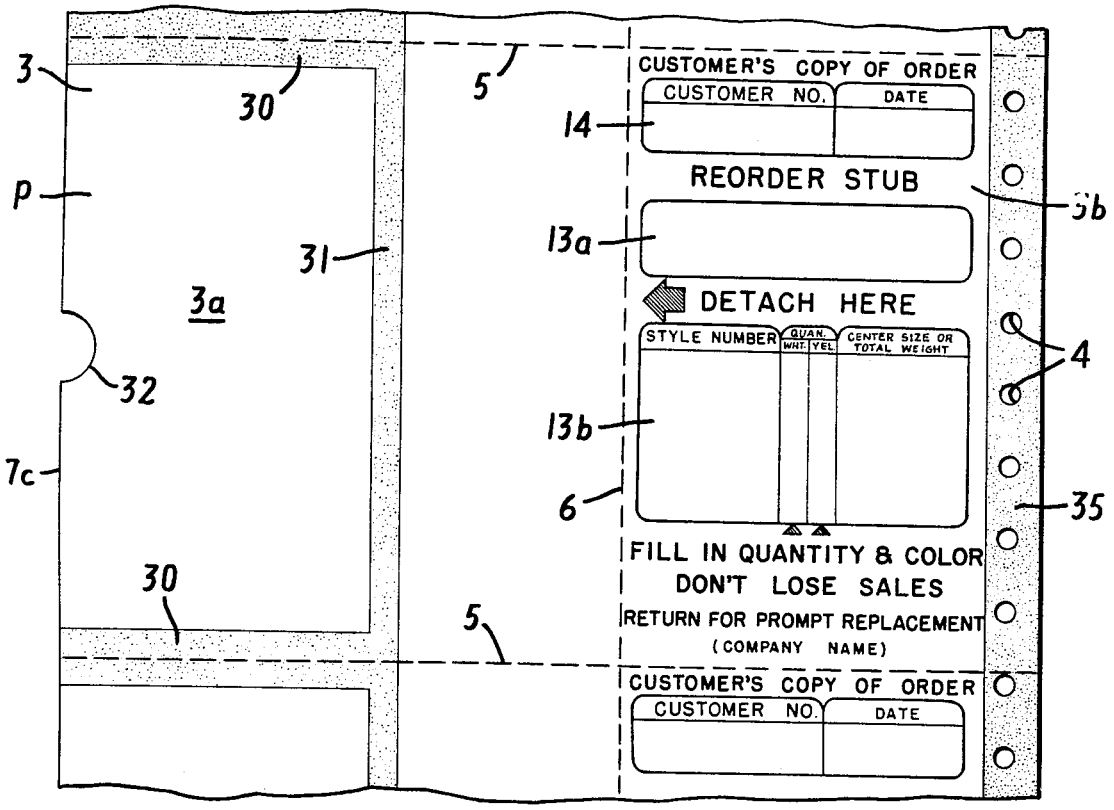
FIG. 3 is a corresponding view showing the third ply.
Figure 5:
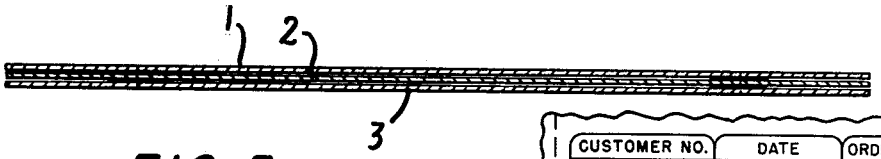
FIG. 5 is a transverse section taken approximately on a line 5—5 in FIG. 1.
Figure 6:
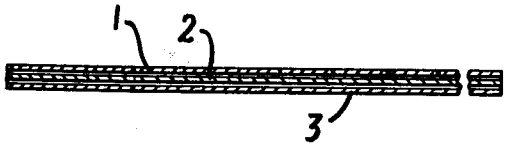
FIG. 6 is a partial section taken approximately on a line 6—6 in FIG. 1.

The portion 3*a* of the third ply 3 at the left of the tear line 6 as viewed in FIG. 3 is attached to the back of the portion 2*a* of the second ply along glue lines 30 and 31 to form a pocket P for receiving an IBM or other card (not shown) for controlling the processing of the order of merchandise to be received in the envelope E. The glue lines 30 extend along the transverse tear lines 5 but the glue line 31 is shown as spaced to the left of the longitudinal tear line 6 to provide a pocket of suitable depth for the card that is to be received. It will be understood that the glue line 31 is located as desired according to the size of the card. Moreover as seen in FIG. 4, the left-hand edge 7*c* of the portion 3*a* of the third ply 3 is spaced inwardly from the left-hand margin of the manifold. Hence the feed holes 4 at the left-hand side of the manifold extend only through the second ply 2. The width of the third ply 3 is coordinated with the location of the glue line 31 to provide a pocket P of the desired depth. An arcuate cut-out 32 is provided in the edge 7*c* of the portion 3*a* to facilitate insertion and withdrawal of a card received in the pocket P.

The portion 3*b* of the third ply 3 at the right-hand side of the tear line 6 as seen in FIG. 3, constitutes a duplicate of the reorder stub and contains the same information as the stub 2*b* including a description 13*a* of the merchandise, identification 13*b* of the style, etc., of the merchandise and customer's number 14. The duplicate reorder stub 3*b* is removably attached to the reorder stub 2*b* by a glue line 35 which, like the glue line 25, is of suitable width and strength to attach the stubs to one another while permitting them to be readily separating without tearing the stubs. The feed holes 4 at the right-hand side of the manifold extend through all three plies.

Suitable means is provided to that information applied to the portion 1*b* of the first ply 1 is transferred to the portion 2*b* of the second ply 2 and to the portion 3*b* of the third ply 3. For example, carbon paper inserts may be provided between the first, second and third plies or a carbon coating or carbon spots may be provided on the backs of the portions 1*b* and 2*b*. Hence when the manifold is run through processing equipment, for example, a high speed printer, controlled by a computer or other control means, information printed or impressed on portion 1*b* of the first ply will simultaneously be applied to portions 2*b* and 3*b* of the second and third plies.

The control card inserted in the pocket P is, for example, an IBM card or computer programming card which controls the filling and processing of the order for merchandise to be shipped in the envelope E. The card may, for example, contain information for manufacturing or assembling the merchandise or for selecting it from stock. Moreover the cards may be used to control the printing or other processing equipment used for applying to the manifold the information appearing on part 1*a* of the first ply and on parts 1*b*, 2*b* and 3*b* of the first, second and third plies.

Figure 7:
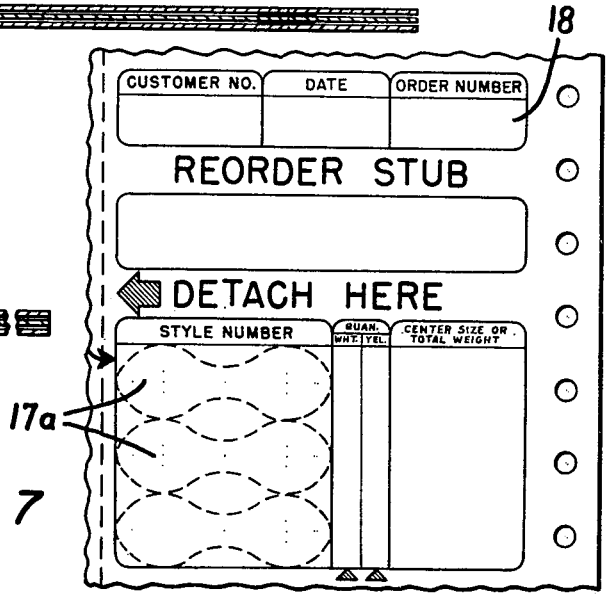
FIG. 7 is a fragmentary view corresponding to a portion of FIG. 1 but showing a modification.

In FIG. 7 there is shown a modification in which the tags or labels 17*a*, instead of being rectangular, are dumbbell-shaped with a central portion of lesser width so that they can be applied still more readily to the shank of a ring. Moreover the form of the reorder stub is modified in order to provide for entry of an order number 18, in addition to the other information shown in FIG. 1. It will be understood that the same information appears on the reorder stub and duplicate reorder stub of the second and third plies.

When an order is filled, the merchandise identified by the information on the envelopes is inserted into the respective envelopes and the flaps 23 are sealed to close the envelopes. The successive units of the manifold are separated from one another, for example, by suitable burster equipment, either before or after insertion of the merchandise into the envelopes. However the portions 1*b*, 2*b* and 3*b* are left attached to the envelopes. The control cards are removed from the pockets P and retained by the supplier for record purposes or future use. When the customer, for example, a retailer, receives a shipment, he removes the merchandise from the envelope and applies to the individual articles the tags or labels 17 which he separates from the portion 1*b* of the first ply. The remaining part of the portion 1*b* may be left attached to the envelope or may be discarded. The reorder stub 2*b* and duplicate reorder stub 3*b* are detached from the envelope and may be kept in a suitable file drawer or box to provide a convenient inventory of the merchandise received. When it is desired to reorder the merchandise, a customer merely fills in the number of items of each style number that he desires to reorder, sends the reorder stub back to the supplier and keeps the duplicate reorder stub for his records. In the form shown by way of example in the drawings the reorder stub is made still more convenient by providing separate columns for white or yellow gold in which the item is to be supplied. Upon receiving the reorder stub, the supplier has all the information that he needs for quickly and economically filling the new order. It will thus be seen that the manifold of the present invention is convenient and economical to use both by the supplier and by the customer.

While a preferred embodiment of the invention has been shown by way of example in the drawings and is herein particularly described, the invention is in no way limited to such embodiment. Instead of having three identifying tags or labels 17 as shown in the drawings, any desired number of detachable tags or labels can be provided. If more tags or labels are desired, the form can be made suitably wider or longer and, if desired, detachable tags or labels can be provided on one or more plies in addition to the front ply. The labels are preferably outlined in ink along the perforation lines so that their outlines are more readily visible. The printing on the form may, if desired, be of a character suitable for optical scanning or for magnetic reading. Moreover, the information on the forms may be suitably coded. Although feed holes have been shown at both edges of the manifold in accordance with present practice, the holes at one or both edges may be omitted if not required by the equipment on which the manifold is processed. Moreover, the pocket provided on the back of the envelope for a control card may be made larger or smaller as desired or it may be omitted if not required.

It will be understood that still other modifications may be made according to the requirements of the particular industry or merchandising field to which the manifold is applied. For example, instead of having only three plies, additional plies may be included, for example, to provide duplicate records or a return envelope. While the flap 23 of the envelope E is shown as being gummed, the envelope can be closed in any other convenient manner, for example, by stapling. The invention is hence in no way limited to the specific embodiments shown by way of example in the drawings.

What I claim and desire to secure by Letters Patent is:

1. A continuous manifold comprising three continuous bands of paper superposed on one another to form a three-ply structure, means defining feed holes in at least one of the plies adjacent each of the side edges of the manifold, longitudinally spaced transverse lines of perforations through all of said plies dividing said manifold into a succession of contiguous like rectangular units extending across said manifold, a line of perforations through all of said plies extending longitudinally of said manifold between the side edges thereof and positioned farther from a first side edge than from a second side edge, said longitudinally extending line of perforations dividing each of said rectangular units into a larger rectangular portion and a smaller rectangular portion, means bonding the first and second plies of the larger rectangular portion of each of said rectangular units together along said transverse and longitudinal lines of perforations to form a merchandise receiving container open at the edge disposed at said first side edge of the manifold and closed at the other three edges of the container, means on the first ply of said container forming portion identifying merchandise received in said container, the customer to whom said merchandise is to be shipped and an order number, perforations in the smaller rectangular portion of the first ply defining a plurality of severable identification labels for attachment to individual articles of merchandise received in said container, means on each of said labels for identifying said articles of merchandise, said larger rectangular portion of the second ply forming the back of said container, the smaller rectangular portion of the second ply and the underlying portion of the third ply constituting severable duplicate reorder stubs, means on each of said stubs indentifying the customer and the merchandise and providing space for filling in the quantity of the merchandise reordered, duplicating means between the smaller rectangular portions of the first, second and third plies for transferring information imprinted on said first ply to said second and third plies, said third ply being narrower than said second ply and having an edge spaced inwardly from said first side edge of the second ply, means bonding the second and third plies of each of said rectangular units together along said transverse lines of perforations and along a line extending longitudinally of said manifold between the side edges thereof to define a pocket open at one end to receive a card for controlling the filling of the order for merchandise to be shipped in said container.

2. A continuous manifold according to claim 1, in which at said first side of the manifold the second ply extends beyond the first ply to provide a flap foldable over the first ply to close the open end of said container.

3. A continuous manifold according to claim 2, having adhesive on said flap forming portion of said second ply to secure said flap in closed position.

4. A continuous manifold according to claim 1, having adhesive on the under surface of said label forming portions of said first ply for securing said labels to articles of merchandise.

5. A continuous manifold according to claim 4, in which said labels are dumbbell-shaped with reduced central portions.

6. A continuous manifold according to claim 1, in which said means bonding the second and third plies together comprises a line of adhesive located between and spaced from said longitudinally extending line of perforations and the open end of said pocket.

7. A continuous manifold comprising three separate continuous band of paper superposed on one another to form a three-ply structure, longitudinally spaced transverse lines of perforations through all of said plies dividing said manifold into a succession of contiguous like rectangular units extending across said manifold, a line of perforations through all of said plies extending longitudinally of said manifold between first and second side edges thereof and dividing each of said rectangular units into a first portion and a second portion, means bonding the first and second plies of the first portion of each of said rectangular units together along said transverse and longitudinal lines of perforations to form a merchandise receiving container open at the edge disposed at said first side edge of the manifold, means for closing said container, means on the first ply of said container forming portion identifying merchandise received in said container, the customer to whom said merchandise is to be shipped and an order number, perforations in said second portion of the first ply defining a plurality of severable identification labels for attachment to individual articles of merchandise received in said container, means on each of said labels identifying said articles of merchandise, said first portion of the second ply forming the back of said container, the second portion of the second ply and the underlying portion of the third ply constituting severable superposed duplicate upper and lower reorder stubs, coincident means on said superposed reorder stubs identifying the customer and the merchandise and providing coincident spaces for filling in the quantity of the merchandise reordered, and duplicating means between said second portions of the superposed first, second and third plies for transferring information imprinted on said first ply to said second and third plies and for transferring information filled in on said second ply to said third ply, whereby a customer may reorder like merchandise by filling in the desired quantity of merchandise in said spaces on said upper reorder stub, whereby said quantity is reproduced on said lower reorder stub by said duplicating means, sending one of said reorder stubs to the supplier and keeping the other of said reorder stubs for his records.

8. A continuous manifold according to claim 7, in which said third ply at least partially underlies said first portions of said first and second plies and in which there is further provided means bonding said second and third plies along transversely and longitudinally extending lines to define a pocket open at one end to receive a card for controlling the filling of an order for merchandise to be shipped in said envelope.

9. A continuous manifold comprising a plurality of separate continuous bands of paper superposed on one another to form a multiply structure, longitudinally spaced transverse lines of perforations through all of said plies dividing said manifold into a succession of contiguous like rectangular units extending across said manifold, a line of perforations through all of said plies extending longitudinally of said manifold between first and second side edges thereof to divide each of said units into a first portion and a second portion, means bonding two of said plies of said first portion together along each of said transverse and longitudinal lines of perforations to form a merchandise receiving container open at the edge disposed at said first side edge of the manifold to receive said merchandise, means for closing said container, means on said container forming portion identifying merchandise received in said container, the customer to whom said merchandise is to be shipped and an order number, means on each of the two plies of said second portion defining superposed duplicate upper and lower reorder forms, said means comprising means identifying the merchandise in said container and the customer and providing space for filling in the quantity of merchandise to be reordered, duplicating means between said upper and lower reorder forms for transferring information entered on said upper reorder form to the lower reorder form, whereby a customer may reorder like merchandise by filling in the desired quantity of merchandise on said upper reorder form, whereby said quantity is reproduced on said lower reorder form by said duplicating means, sending one of said reorder forms to the supplier and keeping the other of said reorder forms for his records; and said second portion of each said unit comprising a third ply and perforations in said third ply defining a plurality of severable identification labels for attachment to individual articles of merchandise received in said envelope.

10. A continuous manifold according to claim 9, in which said first portion of each said unit comprises a third ply secured to said container along transversely and longitudinally extending lines to define an external pocket open toward said first side edge of the manifold to receive a card for controlling the filling of an order of merchandise to be shipped in said container.

11. A continuous manifold comprising a plurality of separate continuous bands of paper superposed on one another to form a multiply structure, longitudinally spaced transverse lines of perforations through all of said plies dividing said manifold into a succession of contiguous like rectangular units extending across said manifold, a line of perforations through all of said plies extending longitudinally of said manifold between first and second side edges thereof to divide each of said units into a first portion and a second portion, means bonding two of said plies of said first portion together along each of said transverse and longitudinal lines of perforations to form a merchandise receiving container open at the edge disposed at said first side edge of the manifold to receive said merchandise, means for closing said container, means on said container identifying merchandise received in said container, the customer to whom said merchandise is to be shipped and an order number, duplicating means between superposed second portions of two of said plies for transferring information entered on the uppermost of said two plies to the underlying of said two plies, coincident means on said second portions of said two superposed plies identifying the customer, an order number and the merchandise in said container, perforations around said merchandise identifying means on said second portion of one of said two plies to provide a severable portion for attachment to an individual article of said merchandise to identify the same, and a blank adjacent said merchandise identification means on the other of said second portions of said superposed plies for filling in the quantity of merchandise to be reordered, whereby a customer can reorder like merchandise by filling in the desired quantity of merchandise in said blank and sending said other second portion to the supplier.

12. A continuous manifold according to claim 11, in which said perforations in said second portion of a ply define a plurality of said severable portions for attachment to individual articles of merchandise.

13. A continuous manifold comprising a plurality of separate continuous bands of paper superposed on one another to form a multiply structure, longitudinally spaced transverse lines of perforations through all of said plies dividing said continuous manifold into a succession of contiguous like rectangular units extending across said manifold, a line of perforations through all of said plies extending longitudinally of said manifold between first and second side edges thereof to divide each of said units into a first portion and a second portion, means bonding two of said plies of said first portion together along each of said transverse and longitudinal lines of perforations to form a merchandise receiving container open at the edge disposed at said first side edge of the manifold to receive said merchandise, means for closing said container, means on said container identifying merchandise received in said container, the customer to whom said merchandise is to be shipped and an order number, coincident means on said second portions of two of said superposed plies identifying the customer, an order number and the merchandise in said container, duplicating means between said second portions of said two superposed plies, and coincident means on said second portions of said two superposed plies providing a blank adjacent said merchandise identification means on each of said second portions of said two superposed plies for filling in a quantity of merchandise to be reordered, whereby a customer can reorder like merchandise by filling in the desired quantity of merchandise in said blank on the uppermost of said two plies whereby said quantity is automatically duplicated in the corresponding blank on the other of said two plies by said duplicating means and sending one of said second portions to the supplier and keeping the other of said second portions for his records.

14. A continuous manifold according to claim 13, in which said merchandise identifying means on each of said superposed reorder forms comprises means identifying a plurality of different items of merchandise and in which said blank providing means comprises means providing an individual blank for filling in the quantity of merchandise to be reordered adjacent each of said identifying means for each of said items.

* * * * *